US006843177B2

(12) United States Patent
Ellis, II

(10) Patent No.: US 6,843,177 B2
(45) Date of Patent: Jan. 18, 2005

(54) METHODS AND MATERIALS FOR PRODUCING AN IMAGE, AND ARTICLES COMPRISING MATERIALS FOR PRODUCING AN IMAGE

(75) Inventor: Robert K. Ellis, II, Kapaa, HI (US)

(73) Assignee: Fine Arts Group LLC, Aspen, CO (US)

( * ) Notice: Subject to any disclaimer, the term of this patent is extended or adjusted under 35 U.S.C. 154(b) by 76 days.

(21) Appl. No.: 09/954,447

(22) Filed: Sep. 14, 2001

(65) Prior Publication Data

US 2003/0051623 A1 Mar. 20, 2003

(51) Int. Cl.[7] ..... B41F 1/54
(52) U.S. Cl. ..... 101/483; 428/195
(58) Field of Search ..... 101/483, 129; 427/262; 428/195; 347/101, 105

(56) References Cited

U.S. PATENT DOCUMENTS

| | | | | |
|---|---|---|---|---|
| 4,285,744 A | | 8/1981 | Rudolf et al. | 264/491 |
| 4,737,329 A | | 4/1988 | Rakoczy | 264/132 |
| 4,893,558 A | | 1/1990 | Gouch | 101/211 |
| 5,493,971 A | | 2/1996 | Lewis et al. | 101/454 |
| 5,568,248 A | | 10/1996 | Wagley | 399/156 |
| 5,612,172 A | | 3/1997 | Wess et al. | 430/347 |
| 5,676,707 A | * | 10/1997 | Kuwabara et al. | 347/101 |
| 5,725,961 A | * | 3/1998 | Ozawa et al. | 347/105 |
| 5,819,664 A | | 10/1998 | Steckler | 1/483 |
| 5,885,720 A | | 3/1999 | Fujiwara et al. | 428/511 |
| 5,911,855 A | | 6/1999 | Dransmann et al. | 428/195 |
| 5,948,534 A | | 9/1999 | Altavilla | 428/423.7 |
| 5,968,607 A | | 10/1999 | Lovison | 101/492 |
| 6,022,588 A | * | 2/2000 | Wakat | 427/262 |
| 6,177,188 B1 | * | 1/2001 | Ichioka et al. | 347/105 |
| 6,444,294 B1 | * | 9/2002 | Malhotra et al. | 428/195 |
| 6,495,242 B1 | * | 12/2002 | Tsuchiya et al. | 428/195 |
| 6,555,207 B2 | * | 4/2003 | Kondo et al. | 428/195 |

OTHER PUBLICATIONS

Hawley's Condensed Chemical Dictionary, Eleventh Edition ©1987, Van Nostrand Renhold Co., p. 1222.*

* cited by examiner

*Primary Examiner*—Eugene H. Eickholt
(74) *Attorney, Agent, or Firm*—Brinks Hofer Gilson & Lione; Gregory H. Zayia

(57) ABSTRACT

A method of producing an image is described which includes depositing onto a substrate a material capable of sustaining a relief feature imparted thereto. A coloring agent is applied directly to this material. A material for producing an image is also described which includes an emulsive agent and a viscosity control agent. In addition, an article is described which includes a relief layer and a coloring layer directly in contact with the relief layer. The relief layer includes a material containing an emulsive agent and a viscosity control agent.

34 Claims, No Drawings

METHODS AND MATERIALS FOR PRODUCING AN IMAGE, AND ARTICLES COMPRISING MATERIALS FOR PRODUCING AN IMAGE

BACKGROUND

This invention relates to the field of printing and, more particularly, to the production of textured images having three-dimensional topographies.

The production of two-dimensional printed images is readily achieved using methods and materials well known in the printing art. However, in order to produce textured images—for example, fine art prints of oil paintings in which the textures created by the artist's brushstrokes are reproduced in the print—more complex and more costly production procedures are generally required.

One method for producing images having such three-dimensional topographies has been to shape or mold layers of plastic films using heat, pressure, and/or vacuum to provide a textured base, and then apply the desired image onto the molded shape using what are known in the art as transfer methods. An intermediate layer interposed between the molded shape and the ink is generally required to ensure proper adherence of the ink to the molded shape. Such methods of production are elaborate and expensive.

A four-step process for creating textured images is described in U.S. Pat. No. 5,819,664 to Steckler: an acrylic textured relief layer is created from a digital representation of an image; the textured relief layer is then applied to a substrate; an adhesion layer is then applied to the relief layer; and ink is then applied to the adhesion layer. The acrylic materials used to produce the relief layer do not possess adequate adhesive characteristics to be able to retain or hold an ink layer (e.g., col. 1, II. 63–67). As a result, an adhesion layer must be applied, thereby increasing the cost and complexity of the production process.

The present invention is directed to simplifying and improving the production of images having three-dimensional topographies. Materials are described which have the ability to sustain finely detailed textures, and which can be printed upon directly without the intermediacy of adhesive layers.

SUMMARY

The scope of the present invention is defined solely by the appended claims, and is not affected to any degree by the statements within this summary.

Briefly stated, a method of producing an image embodying features of the present invention includes depositing onto a substrate a material capable of sustaining a relief feature imparted thereto, and applying a coloring agent directly to the material. The material includes an emulsive agent and a viscosity control agent.

A material for producing an image embodying features of the present invention includes an emulsive agent and a viscosity control agent. The viscosity control agent is present in an amount effective for the material to sustain a relief feature imparted thereto.

An article embodying features of the present invention includes a relief layer and a coloring layer in direct contact with the relief layer. The relief layer includes a material containing an emulsive agent and a viscosity control agent.

DETAILED DESCRIPTION OF THE PRESENTLY PREFERRED EMBODIMENTS

A method of producing an image embodying features of the present invention comprises providing a substrate; depositing onto the substrate a material that sustains a relief feature imparted thereto; and applying a coloring agent directly to the material.

The type of substrate used in accordance with this invention is not limited. Suitable substrates include but are not limited to: canvas, paper, wood, ceramic, glass, metal, metal alloy, plaster, fabric, fiber, plastic, and the like, and combinations thereof. Preferably, substrates used in accordance with the present invention have a non-acidic pH value (i.e., pH less than or equal to about 7.0). Preferred substrates include canvas, paper, wood, and metal alloy.

All types of paper products are contemplated for use in the present invention, including but not limited to ones derived from wood pulp, rags, straw, cotton, papyrus, hemp, other fibrous materials, and the like. Additionally, one or more surfaces of the paper products may be coated, for example, with natural or synthetic resins and varnishes, as is common in the art.

All types of metal alloys are contemplated for use in the present invention, including but not limited to steel, bronze, brass, and the like, and combinations thereof.

All manner of fabrics and fibrous material, both natural and synthetic, are contemplated for use in the present invention, including but not limited to: cotton, hemp, rope, flax, linen, wool, rayon, nylon, polyester, and the like, and combinations thereof.

The material deposited on the substrate, which is capable of receiving and maintaining one or more relief features corresponding to the topographical features of the image being reproduced, comprises an emulsive agent and a viscosity control agent.

Throughout this description and in the appended claims, it is to be understood that the materials embodying features of the present invention are generally dried/cured, and preferably textured, prior to the deposition of a coloring agent thereupon. Thus, references to the deposition of a coloring agent onto a material are used interchangeably with references to the deposition of a coloring agent onto a cured relief layer comprised of the material.

In addition, throughout this description and in the appended claims, the term "emulsive agent" is to be understood as referring to a solid substance which may be combined with other solid or non-solid substances to provide a material that is either amenable to texturing, or which can be molded or cured to provide a material that is either textured or is amenable to subsequent texturing; in addition, as used herein, the term "emulsive agent" is to be understood as referring to a substance that is—either by itself or in combination with other ingredients of a formulation—capable of accepting a "coloring agent." Throughout this description and in the appended claims, the term "coloring agent" is to be understood as referring to any substance having a color, and encompasses inks (e.g., dye-based inks, pigment inks, solvent-based inks), pigments, paints, dyes, chalks, and the like.

A wide variety of emulsive agents, both natural and synthetic, are contemplated for use in accordance with the present invention. Suitable emulsive agents include but are not limited to: gelatin derived from acid processed materials (e.g., porkskin), gelatin derived from alkaline or lime processed materials (e.g., cattle, calf hides, ossein), derivatised gelatins (e.g., phthalyl, acetyl, carbamoyl, etc.), polyvinyl acetates, polyvinyl lactams, acrylamide polymers, methacrylamide copolymers, maleic anhydride copolymers, polyamides, polyvinyl pyridines, acrylic acid polymers, maleic acid copolymers, vinylamine copolymers, polystyrenes, polyurethanes, polyvinylpyrrolidone, polyesters, and the like, and combinations thereof.

Preferred emulsive agents are selected from the group consisting of acid-processed gelatin, alkaline-processed gelatin, derivatised gelatin, polyvinylacetate, and combinations thereof. More preferably, the emulsive agent is selected from the group consisting of alkaline-processed gelatin, polyvinylacetate, and combinations thereof.

All manner of gelatin is contemplated for use in accordance with the present invention. However, since many of the papers and inks that are used react unfavorably under acidic environments, gelatin derived from alkaline or lime processed materials is preferred.

Throughout this description and in the appended claims, the term "viscosity control agent" is to be understood in the very general sense of a substance that affects viscosity of a material. The amount of viscosity control agent added to materials embodying features of the present invention will determine the viscosities of these materials, and affect their ability to hold finely detailed textures.

The manner of depositing materials embodying features of the present invention onto substrates is not limited, and encompasses all manner of manual and automated methods. Suitable methods include but are not limited to manual and automated techniques of brushing, rolling, spraying (e.g., via compressed air, inkjet printer, squeeze bottle, etc.), smearing (e.g., via sponge, pallet knife, etc.), and the like, and combinations thereof.

As described hereinbelow, materials embodying features of the present invention can be textured in a variety of ways—both manually and by automated means—including processes involving an implement and processes involving a molding procedure. In addition, texture may be imparted to the materials naturally during the course of deposition onto a substrate (e.g., spraying the materials may initially result in textured rather than planar surfaces).

For processes in which the material is to be applied to a substrate and then textured through the agency of an implement (by hand or by an automated process), a more viscous material is preferred in order that an impression made in the material with the implement will be substantially maintained upon removal of the implement. For processes in which the material is added to a mold having a form corresponding to the topography of the image being replicated, a less viscous (i.e., more fluid) material is preferred in order to facilitate penetration of the material into the nooks and crevices of the mold.

It is preferred that the texturing imparted to a material, and the relief layer created thereby, correspond to the three-dimensional topography of the image to be reproduced. For example, when the image to be reproduced is an oil painting having a region in which paint has been applied thickly to the canvas (i.e., the paint extends from the canvas to a greater extent than in an adjacent region), it is preferred that the relief layer of the reproduction have a corresponding region which resembles the topography of the original (i.e., a material embodying features of the present invention is applied to the substrate more thickly than in an adjacent region). Although it is preferred that the image to be reproduced and the relief layer of the reproduction have substantially similar topographies, such a correspondence in topographies is not essential. Even when the topographies do not correspond well, the existence of a texturing—albeit random—in the relief layer imparts aesthetically pleasing visual qualities to the finished image.

The nature of the viscosity control agent used in accordance with this invention is not limited. Suitable viscosity control agents include but are not limited to: cellulose, derivatised cellulose (e.g., methyl cellulose, ethyl cellulose, hydroxyethyl cellulose, hydroxypropyl methylcellulose, hydroxyethyl cellulose, carboxymethyl cellulose and salts thereof, hydroxypropyl cellulose, cyanoethyl cellulose, etc.), glycogen, starch (e.g., corn starch), derivatised starch, wheat paste, rice paste, acrylic resins, polyvinyl alcohol, polyvinyl pyrrolidone, chondroitin sulfate and salts thereof, hyaluronic acid and salts thereof, sodium alginate, carbomer, povidone, acacia, guar gum, xanthan gum, tragacanth, magnesium aluminum silicate, and the like, and combinations thereof.

Preferred viscosity control agents include cellulose, derivatised cellulose, starch, wheat paste, acrylic resins, and combinations thereof. Preferably, the viscosity control agent is selected from the group consisting of hydroxymethyl cellulose, hydroxyethyl cellulose, hydroxypropyl methylcellulose, cyanoethyl cellulose, and combinations thereof.

As noted above, the amount of viscosity control agent included in materials embodying features of the present invention relates to the manner in which texturing is to be achieved. In general, the viscosity control agent acts as filler, and typically comprises a majority of the composition of materials in accordance with this invention. The appropriate viscosity for a particular application of the material is generally determined through visual inspection. In general, the amount of viscosity control agent will comprise from about 10 to about 95 percent by weight of the combination of emulsive agent and viscosity control agent, more preferably from about 30 to about 95 percent by weight of this combination, and still more preferably from about 50 to about 90 percent by weight of this combination.

Additional substances well known in the art can be added to the materials embodying features of the present invention. For example, pigments may be added to control the white point of a material, which ultimately affects the perceived color of the finished print. In addition, substances that protect the material from harmful environmental influences (e.g., molds, mildews, light, oxidation, etc.) may be added to extend longevity. Furthermore, plasticizers can be added to achieve more flexible textured relief layers and to prevent cracking of the finished printed article. Additionally, agents that control drying/curing times of the material and/or hardness of the dried material can be added to optimize the production process.

Suitable substances which can be added to materials embodying features of the present invention include but are not limited to: pigments, matting agents, and fillers (e.g., calcium carbonate, titanium oxide, iron oxide, aluminum oxide, zinc oxide, zinc sulfide, lithopone, starches, silicas, alumina, zeolite, barium sulphate, aluminum silicate, clay, talcum, calcium sulphate, polyacrylate beads, polystyrene beads, polymethyl methacrylate beads, psuedo-boemite, aluminum silicates, colloidal silicas, etc.), antistatic agents (e.g., polystyrene sulfonate, sodium nitrate, etc.), surfactants, thickeners, emulsifiers, UV absorbers, HAL absorbers, plasticizers, mold release agents, and the like, and combinations thereof. Preferred additives include calcium carbonate and titanium oxide, which are used to control perceived ink color, white point of the material, and dot gain, as described hereinbelow.

Numerous variations in the presently preferred embodiments illustrated herein will be obvious to one of ordinary skill in the art, and remain within the scope of the appended claims and their equivalents. The following representative procedures for making presently preferred embodiments of a material in accordance with the present invention are provided solely by way of illustration, and are not intended to limit the scope of the appended claims or their equivalents.

EXAMPLE 1

1. Four ounces of USP grade 140 bone gelatin (Tri-Ess Sciences, Burbank, Calif.) are dissolved in eight ounces of briskly boiling distilled water. The resultant mixture is allowed to cool to room temperature.

2. In a separate container, two ounces of methylhydroxy cellulose (Tri-Ess Sciences, Burbank, Calif.) are dissolved in four ounces of distilled water at room temperature.

3. The aqueous bone gelatin mixture is combined with the aqueous methylhydroxy cellulose solution in an ordinary household blender and blended together at low speed for about 30 seconds.

4. Two milliliters of USP grade glycol (Tri-Ess Sciences, Burbank, Calif.) are slowly added to the mixture during blending.

5. One-fourth of an ounce of titanium dioxide (Tri-Ess Sciences, Burbank, Calif.) is slowly added to the mixture during blending.

6. The resultant material is allowed to settle at room temperature until it begins to set up to the desired consistency for application to a substrate and subsequent shaping or texturing.

7. The material is textured by one of the methods described hereinbelow or an equivalent technique, and then allowed to harden fully at room temperature over one to two days prior to printing.

In general, the amount of water used in the preceding recipe may be varied preferably by between plus or minus three ounces, more preferably, by between plus or minus two ounces.

EXAMPLE 2

Four liquid ounces by weight of polyvinylacetate (Tri-Ess Sciences, Burbank, Calif.) are combined with four ounces by weight of wheat paste. The resultant material is processed as above. Other ingredients, such as titanium dioxide, can be added as above.

EXAMPLE 3

Approximately equal volumes of polyvinylacetate and corn starch are combined and processed as above. Other ingredients, such as titanium dioxide, may also be added.

Numerous variations in the foregoing representative procedures are possible and will be obvious to one of skill in the art. In particular, the relative amounts of the constituents may be varied in order to prepare materials having varying viscosities.

The material, once prepared, is available for deposition onto the substrate. Materials containing a gelatin-based emulsive agent begin to dry/cure rapidly after the components of the mixture are combined. In contrast, polyvinylacetate-based formulations tend, in general, to cure more slowly. Although curing of the materials embodying features of the present invention is generally achieved at room temperature over one to several days, elevated temperatures, drying ovens, fans, and the like can also be employed to effect shorter curing times.

In general, the presently preferred embodiments are adhesive by nature, and should adhere well to a wide variety of substrates, especially to paper, canvas, wood, and cloth substrates. However, when adherence to a particular substrate (e.g., glass or polished metal) is a concern, a primer coating (e.g., primer paint) can optionally be applied to the substrate prior to deposition of the material, thus increasing the adhesion therebetween. In addition to or in place of a primer coating, adhesion can be promoted by physically roughening the surface of the substrate, thereby increasing the available surface area thereof.

The thickness of the material applied to the substrate, and the thickness of the relief layer formed thereby, are subject to wide variation. Preferably, the relief layer is at least thick enough to provide a thin film capable of receiving ink (e.g., about 0.01 mm). More preferably, the thickness of the relief layer varies from a thin film just covering the substrate to the maximum thickness that may pass through the printer depositing the ink (e.g., with current machines, up to and including about ¼"). Still more preferably, the thickness of the relief layer corresponds as closely as possible to the features of the image being reproduced (e.g., the brushstrokes of an oil painting). The upper end of the range of thicknesses (i.e., ¼) may be expanded with the development of new printers and/or by suitable modification of existing machines. Alternatively, if the ink is to be applied by means other than a printer (e.g., with a paintbrush), the thickness of the relief layer is not limited.

It is preferred that texturing of the material deposited on the substrate is achieved prior to the application of a coloring agent. The manner in which materials embodying features of the present invention are textured in order to provide the desired topography of the image being reproduced is not limited. All manner of texturing and shaping techniques—including future improvements on existing techniques and techniques that have yet to be developed—are applicable and contemplated for use in accordance with the practice of this invention. Presently preferred techniques of texturing and shaping, described hereinbelow, include but are not limited to the use of: an implement (hand-held or automated), a silkscreening process, a molding process, and combinations thereof. In general, methods involving the use of an implement are most applicable to productions of a single piece or to small production runs. Methods involving silkscreening or molding processes are generally preferred for mass productions.

Texturing via an Implement

The substrate is provided with registration marks or tabs to facilitate proper alignment in a printer. A reference print made from an electronic image of the image to be reproduced is then overlaid thereupon. This reference print will typically display areas of highlights or shadows created by the three-dimensional topography of the image being photographed or scanned. These areas serve as guides for the deposition of a textured relief layer.

A material embodying features of the present invention, preferably one comprising one or more additives to establish the requisite white point, is then deposited upon the reference print. The material is textured with any of a variety of implements including but not limited to brushes, rollers, spatulas, sprayers, sponges, pallet knifes, and the like, and combinations thereof. The textured relief layer is then dried/cured at room temperature, typically for about twenty-four hours.

A modified image print is prepared in which the areas of highlights and shadows that provide visual clues to the texturing of the original image are removed using suitable image editing software. The image editing software sold under the tradename ADOBE PHOTOSHOP (Adobe Systems Incorporated, San Jose, Calif.) is especially preferred. The modified image print is used as a guide for the deposition of colors onto the relief layer.

The substrate is reregistered to ensure proper alignment, and ink is applied to the three-dimensional surface of the dried relief layer.

Texturing via Silkscreening

The substrate is provided with registration marks or tabs to facilitate proper alignment in a printer, and a material embodying features of the present invention is applied thereto by a silkscreening process, as known in the art. The material can be deposited in one treatment, or applied in layers, with the latter method being preferred for geometric designs. The textured relief layer is then dried/cured.

A modified image print is prepared as described above, and used as a guide to the deposition of colors onto the relief layer. The substrate is reregistered to ensure proper alignment, and ink is applied to the three-dimensional surface of the dried relief layer.

Texturing via Molding

A mold is prepared having a form corresponding to the topography of the image being reproduced. Preferably, when possible, the mold is cast directly from the original image. However, in instances when the original image cannot be subjected to such a casting procedure (e.g., when the image to be reproduced is a valuable object of fine art), a mold can be prepared indirectly starting from a reference print. The reference print, which is prepared as above, is overlaid on a substrate that has been registered. A material embodying features of the present invention is then deposited on the reference print, and textured with an implement. The resultant relief layer, once hardened, can then serve as the basis for a casting procedure to produce a mold.

When the mold has been cast, materials embodying features of the present invention are then prepared and added thereto. As noted above, a less viscous (i.e., more fluid) material is preferred in order to facilitate penetration of the material into the nooks and crevices of the mold. Preferably, a vacuum is also applied in order to remove bubbles trapped in the material.

A substrate is then placed in contact with the open face of the mold, and the material therein allowed to deposit onto the substrate. The relief layer thus created is dried/cured, and ink is applied to the three-dimensional surface of the dried relief layer using modified image print as above.

In texturing techniques based on a molding process, it may be useful to incorporate a mold release agent into the material. However, the mold release agent is preferably not lubricant-based in order that the ability of the material to receive and adhere to ink is not substantially compromised.

Materials embodying features of the present invention are compatible with and adhere to many coloring agents—notably the inks employed in producing fine art prints and fine art photographic prints, which are typically applied from inkjet printers—and the relief layers comprised thereof can be printed upon directly. Thus, the necessity in conventional printing methods for depositing an adhesive layer between the ink and the relief layer has been eliminated.

All manner of application of a coloring agent to a relief layer is contemplated for use in accordance with the present invention. Suitable application methods include but are not limited to manual and automated techniques of brushing, rolling, spraying (e.g., via inkjet printer, spray can, etc.), sponging, and the like, and combinations thereof. Preferably, a coloring agent is applied to the material by automated means. More preferably, the printing process is automated to enable the mass production of multiple (i.e., anywhere from two up to as many as are desired) reproductions of an original image.

It is preferred that the color or combination of colors applied to particular relief features of the relief layer will correspond to the color or combination of colors present on corresponding relief features of the image to be reproduced. For example, when the image to be reproduced is an oil painting having a particularly textured brush stroke of a certain color extending from the canvas in a given region, it is preferred that the relief layer of the reproduction have a similarly-textured relief feature located in a corresponding region of the substrate which has been covered with a similar color. Although it is preferred that the colors of the finished printed image be located on relief features that correspond in color and topography to the relief features of the image to be reproduced, such a correspondence is not essential. Even when the colors applied to the relief layer have been offset from the relief features to which they corresponded in the original image, the finished printed image will nonetheless possess aesthetically pleasing visual qualities.

Admirable control over "dot gain" (i.e., the increase in circumference of an ink droplet upon striking a print surface) is observed when ink is applied to a relief layer made in accordance with the present invention. This increased control over dot gain as compared to the control achievable in conventional printing methods corresponds to a better control over the perceived colors of a finished print.

All manner and hues of inks are contemplated for use in accord with the present invention, including dye-based inks, pigment inks, solvent-based inks, and combinations thereof. For applying ink to a material comprised of a gelatin-based emulsive agent, best results are achieved with water-soluble inks. Thus, the type of ink applied to a relief layer comprising a gelatin-based emulsive agent is preferably selected from the group consisting of pigment-based inks, dye-based inks, and a combination thereof. Dye-based inks are especially preferred in this context. Pigment-based inks containing an ammoniated carrier are preferred when the relief layer comprises a polyvinylacetate-based emulsive agent.

Pigment-based inks are generally not as susceptible to environmental influences as dye-based inks, and are preferred when the longevity of a finished print is a primary objective. However, at present, the color gamut of pigment-based inks is more limited than the corresponding gamut available for dye-based inks, and the latter are preferred when a broader color gamut is a primary objective.

As is known in the art, inkjet and related printers used in the production of high quality prints do not spray white ink. Rather, the color of the material or substrate being printed upon is expected to provide the "white point" of the finished print. Moreover, a consistent white is needed to create International Color Consortium (ICC) Profiles, which enable printers to apply predictable colors based on what is seen on a computer monitor. In modern printing systems, the use of ICC profiles is an important strategy for establishing cost effective workflows.

The white point of a material greatly affects the perceived color of the finished print. As noted above, the white point of the relief layers may be provided and/or adjusted by including additives such as calcium carbonate and titanium dioxide in the materials used for their preparation. When a reference print is interposed between the substrate and the relief layer (e.g., when texturing is achieved with an implement), it may be particularly important to establish a white point of the material comprising the relief layer.

After the ink applied to the relief layer has dried, a final coating or varnish can optionally be applied to the surface of the finished print. This coating can protect the finished print from fingerprints, dirt, and the like, and facilitates cleaning. In addition, the final coating may include UV and/or HAL absorbers and, as such, is especially preferred when used in conjunction with light-sensitive inks.

Throughout this description and in the appended claims, it is to be understood that elements referred to in the singular (e.g., a coloring agent, a viscosity control agent, a substrate, a material, an emulsive agent, and the like), refer to one or a plurality of such elements, regardless of the tense employed.

The foregoing detailed description and examples have been provided by way of explanation and illustration, and are not intended to limit the scope of the appended claims. Many variations in the presently preferred embodiments illustrated herein will be obvious to one of ordinary skill in the art, and remain within the scope of the appended claims and their equivalents.

What is claimed is:

1. A method of producing an image comprising:

providing a substrate;

depositing onto the substrate a material that sustains a relief feature imparted thereto, the material comprising an emulsive agent and a viscosity control agent; and applying a coloring agent directly to the material, wherein the material is dried prior to application of the coloring agent.

2. The method of claim 1 further comprising texturing the material to correspond to a topography of the image.

3. The method of claim 1 wherein the substrate is comprised of a material selected from the group consisting of canvas, paper, wood, ceramic, glass, metal, metal alloy, plaster, fabric, fiber, plastic, and combinations thereof.

4. The method of claim 1 wherein the emulsive agent is selected from the group consisting of acid-processed gelatin, alkaline-processed gelatin, derivatised gelatin, polyvinylacetate, and combinations thereof.

5. A method of producing an image comprising:

providing a substrate;

depositing onto the substrate a material that sustains a relief feature imparted thereto, the material comprising an emulsive agent and a viscosity control agent, wherein the emulsive agent comprises alkaline-processed bone gelatin; and applying a coloring agent directly to the material.

6. The method of claim 1 wherein the viscosity control agent is selected from the group consisting of cellulose, derivatised cellulose, starch, wheat paste, acrylic resins, and combinations thereof.

7. The method of claim 1 wherein the viscosity control agent is selected from the group consisting of hydroxymethyl cellulose, hydroxyethyl cellulose, hydroxypropyl methylcellulose, cyanoethyl cellulose, and combinations thereof.

8. The method of claim 1, wherein the emulsive agent comprises polyvinylacetate.

9. The method of claim 1 wherein the material further comprises an ingredient selected from the group consisting of pigments, matting agents, fillers, antistatic agents, surfactants, emulsifiers, UV absorbers, HAL absorbers, plasticizers, and combinations thereof.

10. The method of claim 1 wherein the material further comprises one or more ingredients selected from the group consisting of calcium carbonate, titanium oxide, and a combination thereof.

11. The method of claim 1 wherein the depositing of the material is achieved manually.

12. The method of claim 1 wherein the depositing of the material is achieved by automation.

13. The method of claim 2 wherein the texturing is achieved manually.

14. The method of claim 2 wherein the texturing is achieved by automation.

15. The method of claim 2 wherein the texturing is achieved with an implement selected from the group consisting of brushes, rollers, spatulas, sprayers, sponges, pallet knifes, and combinations thereof.

16. The method of claim 2 wherein the texturing is achieved with a silkscreening process.

17. A method of producing an image comprising:

providing a substrate;

depositing onto the substrate a material that sustains a relief feature imparted thereto, the material comprising an emulsive agent and a viscosity control agent;

texturing the material to correspond to a topography of the image, wherein the texturing is achieved with a mold having a form that corresponds to the topography of the image; and applying a coloring agent directly to the material.

18. A method of producing an image comprising:

providing a substrate;

overlaying the substrate with a reference print of the image;

depositing onto the substrate a material that sustains a relief feature imparted thereto, the material comprising an emulsive agent and a viscosity control agent; and applying a coloring agent directly to the material.

19. The method of claim 1 wherein the applying of the coloring agent is achieved manually.

20. The method of claim 1 wherein the applying of the coloring agent is achieved by automation.

21. The method of claim 1 wherein the coloring agent is applied with an inkjet printer.

22. The method of claim 1 wherein the coloring agent is selected from the group consisting of dye-based inks, pigment inks, solvent-based inks, and combinations thereof.

23. The method of claim 1 wherein the coloring agent is water-soluble.

24. The method of claim 1 further comprising applying a primer coating to the substrate whereby adhesion between the substrate and the material is increased.

25. The method of claim 1 further comprising applying a finishing coat overlying the coloring agent.

26. A method of mass-producing an image comprising:

providing a substrate;

depositing onto the substrate a material that sustains a relief feature imparted thereto, the material comprising an emulsive agent and a viscosity control agent; and applying a coloring agent directly to the material by an automated printing process.

27. The method of claim 16 further comprising texturing the material to correspond to a topography of the image by a silkscreening process.

28. A method of mass-producing an image comprising:

providing a substrate;

depositing onto the substrate a material that sustains a relief feature imparted thereto, the material comprising an emulsive agent and a viscosity control agent;

texturing the material to correspond to a topography of the image by a molding process; and applying a coloring agent directly to the material by an automated printing process.

29. A material for producing an image comprising:

an emulsive agent; and a viscosity control agent, wherein the viscosity control agent is present in an amount effective for the material to sustain a relief feature imparted thereto, and wherein the material is dried prior to application of a coloring agent thereupon.

30. A material for producing an image comprising:

an emulsive agent selected from the group consisting of acid-processed gelatin, alkaline-processed gelatin, derivatised, polyvinylacetate, and combinations thereof; and a viscosity control agent, which is present in an amount effective for the material to sustain a relief feature imparted thereto.

31. The material of claim 30 wherein the viscosity control agent is selected from the group consisting of cellulose, derivatised cellulose, starch, wheat paste, acrylic resins, and combinations thereof.

32. The material of claim 30 wherein the viscosity control agent is selected from the group consisting of hydroxymethyl cellulose, hydroxyethyl cellulose, hydroxypropyl methylcellulose, cyanoethyl cellulose, and combinations thereof.

33. The material of claim 30 further comprising an ingredient selected from the group consisting of pigments, matting agents, fillers, antistatic agents, surfactants, emulsifiers, UV absorbers, HAL absorbers, plasticizers, and combinations thereof.

34. The material of claim 30 further comprising one or more ingredients selected from the group consisting of calcium carbonate, titanium oxide, and a combination thereof.

* * * * *

UNITED STATES PATENT AND TRADEMARK OFFICE

CERTIFICATE OF CORRECTION

PATENT NO. : 6,843,177 B2
DATED : September 14, 2001
INVENTOR(S) : Robert K. Ellis, II It is certified that error appears in the above-identified patent and that said Letters Patent is hereby corrected as shown below:

Title page,
Item [*] Notice, should read -- Subject to any disclaimer,the term of this patent is extended or adjusted under 35 U.SC. 154(b) by 196 days. --.

Signed and Sealed this

Sixteenth Day of August, 2005

JON W. DUDAS
*Director of the United States Patent and Trademark Office*

UNITED STATES PATENT AND TRADEMARK OFFICE

CERTIFICATE OF CORRECTION

PATENT NO. : 6,843,177 B2
DATED : January 18, 2005
INVENTOR(S) : Robert K. Ellis, II It is certified that error appears in the above-identified patent and that said Letters Patent is hereby corrected as shown below:

Title page,
Item [*] Notice, should read -- Subject to any disclaimer, the term of this patent is extended or adjusted under 35 U.S.C. 154(b) by 196 days. --.

This certificate supersedes Certificate of Correction issued August 16, 2005.

Signed and Sealed this

Eighteenth Day of October, 2005

JON W. DUDAS
*Director of the United States Patent and Trademark Office*